US012678018B2

(12) United States Patent
Kane

(10) Patent No.: US 12,678,018 B2
(45) Date of Patent: Jul. 14, 2026

(54) DISH DRYING MAT

(71) Applicant: MACNEIL IP LLC, Bolingbrook, IL (US)

(72) Inventor: Stephen Kane, Cedar Lake, IN (US)

(73) Assignee: MACNEIL IP LLC, Bolingbrook, IL (US)

( * ) Notice: Subject to any disclaimer, the term of this patent is extended or adjusted under 35 U.S.C. 154(b) by 74 days.

(21) Appl. No.: 18/807,119

(22) Filed: Aug. 16, 2024

(65) Prior Publication Data

US 2026/0047743 A1 Feb. 19, 2026

(51) Int. Cl.
*A47L 19/02* (2006.01)

(52) U.S. Cl.
CPC ..... *A47L 19/02* (2013.01)

(58) Field of Classification Search
CPC ..... A47L 19/02; E03C 1/186; A47J 47/20
See application file for complete search history.

(56) References Cited

U.S. PATENT DOCUMENTS

D20,922 S * 7/1891 Coben ..... D32/56
1,349,771 A * 8/1920 Kline ..... A47L 19/02 99/425
1,479,361 A * 1/1924 Blevens ..... A47K 5/03 312/351
1,535,928 A * 4/1925 Loudon ..... A47L 19/02 4/656
1,628,746 A * 5/1927 Russel ..... A47L 19/02 134/92
1,643,906 A * 9/1927 Russel ..... A47L 19/02 4/656
1,718,126 A * 6/1929 Elovson ..... E03C 1/186 4/658
1,728,502 A * 9/1929 McGregor ..... A47L 19/02 99/425
4,480,343 A * 11/1984 Drach ..... A47L 19/00 211/2
4,993,546 A * 2/1991 Southard ..... A47K 1/08 D6/532
5,105,485 A * 4/1992 Sciabarassi ..... A47J 47/20 4/656
D344,828 S * 3/1994 Adams ..... D32/56
D376,882 S * 12/1996 Cook ..... D32/55
D595,466 S * 6/2009 Sofy ..... D32/56
9,962,042 B2 * 5/2018 Hierath ..... A47K 5/02
D891,018 S * 7/2020 Evans ..... D32/58
10,842,300 B2 * 11/2020 Reid ..... A47G 7/044
D962,318 S * 8/2022 Liao ..... D15/152
2007/0090063 A1 * 4/2007 Schmidt ..... A47L 19/04 211/41.3
2021/0186302 A1 * 6/2021 Aparri ..... A47L 19/02
2025/0352024 A1 * 11/2025 Greco ..... A47L 19/02

* cited by examiner

*Primary Examiner* — Ko H Chan
(74) *Attorney, Agent, or Firm* — Perkins IP Law Group LLC; Jefferson Perkins

(57) ABSTRACT

A sloping upper surface of a dish mat is supported by nonrectangular support ribs, whose depth decreases as a function of distance from the back of the dish mat body. Angled ribs in a left portion and in a right portion of the upper surface direct fluid to a central channel, which in turn directs the fluid to a spillway. The spillway forwardly and downwardly extends into a sink at which the dish mat has been positioned.

13 Claims, 5 Drawing Sheets

DISH DRYING MAT

BACKGROUND OF THE INVENTION

It is known to deploy a dish drying mat at the boundary of a kitchen sink. Conventional dish drying mats may be made of silicone or textile. Ones molded of plastic or silicone often have upstanding ribs which permit the bottoms of dishes, glassware, utensils and the like to dry. These conventional dish drying mats have horizontal upper surfaces which collect standing water that does not drain and may therefore overflow onto the general kitchen counter surface or take a long time to evaporate.

SUMMARY OF THE INVENTION

According to one aspect of the invention, there is provided a mat on which dishware may be placed in connection with a process for their cleaning. The mat has a plurality of elongate, spaced-apart support ribs that each downwardly extend from a general lower surface of a mat body to a lower margin of the support rib. Each support rib has a back end that is relatively near the back of the mat body, and a front end that is relatively remote therefrom. A depth of each support rib, as measured from the general lower surface of the mat body to the lower margin of the rib, decreases as a function of the distance from the back end of the support rib. This decrease in depth causes the general upper surface of the mat body to downwardly slope from the back of the mat body to the front thereof. This promotes drainage of fluid off of the upper surface of the mat and into the adjacent sink.

According to another aspect of the invention, a mat, on which dishware may be placed in connection with a process for cleaning them, comprises a body with a general upper surface. The general upper surface of the body downwardly slopes from a back of the body to a front thereof. The general upper surface includes an elongate channel that extends from the back of the body to the front of the body. This channel is aligned with a length of the mat body and is disposed between a left margin of the body and a right margin thereof. A plurality of elongate, spaced apart ribs each upwardly extend from the general upper surface of the body. The body has a left portion disposed to the left of the channel and a right portion disposed to the right of the channel. The ribs include left ribs on the left portion and right ribs on the right portion. Back ends of the left ribs are disposed relatively proximate to the left margin of the body and to the back of the body. Front ends of the left ribs are disposed to be relatively proximate the channel and the front of the body. Similarly, back ends of the right ribs are disposed to be relatively proximate to the right margin of the body and to the back of the body. Front ends of the right ribs are disposed to be relatively proximate to the channel and the front of the body. Fluid from the dishware will be directed by the ribs to the channel, and then will be directed by the channel to the front of the body.

In a further aspect of the invention, a mat is provided on which dishware may be placed in connection with a process for their cleaning. The mat comprises a body with a general upper surface that is downwardly sloped from a back of the body to a front of the body. A substantially vertical and planar front sidewall is disposed at the front of the body. This front sidewall is interrupted by a spillway, which forwardly extends from the front sidewall. An upper surface of the spillway extends downwardly from the general upper surface of the body. The spillway may be positioned over a sink edge and will direct fluid collecting on the general upper surface of the body into the sink.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

As used herein, "dishware" includes all vessels and implements used in the cooking, storing and consumption of food and beverages, including containers, plates, bowls, cups, knives, forks, spoons, skewers, mugs, glasses, pitchers, frying pans, cooking vessels, griddles, racks and any other such implements typically used for this purpose. After use, it is the common practice to clean and dry such dishware prior to the dishware being put away. The dishware may have fluid (grease, sauces, etc.) on them prior to being cleaned, and may have water on them afterward as they are drying. The dish mat according to the invention directs fluid of both kinds into an adjacent sink.

The term "longitudinal" means a front-to-back horizontal direction. The term "transverse" means a side-to-side horizontal direction at right angles to the longitudinal direction.

Figure 1:
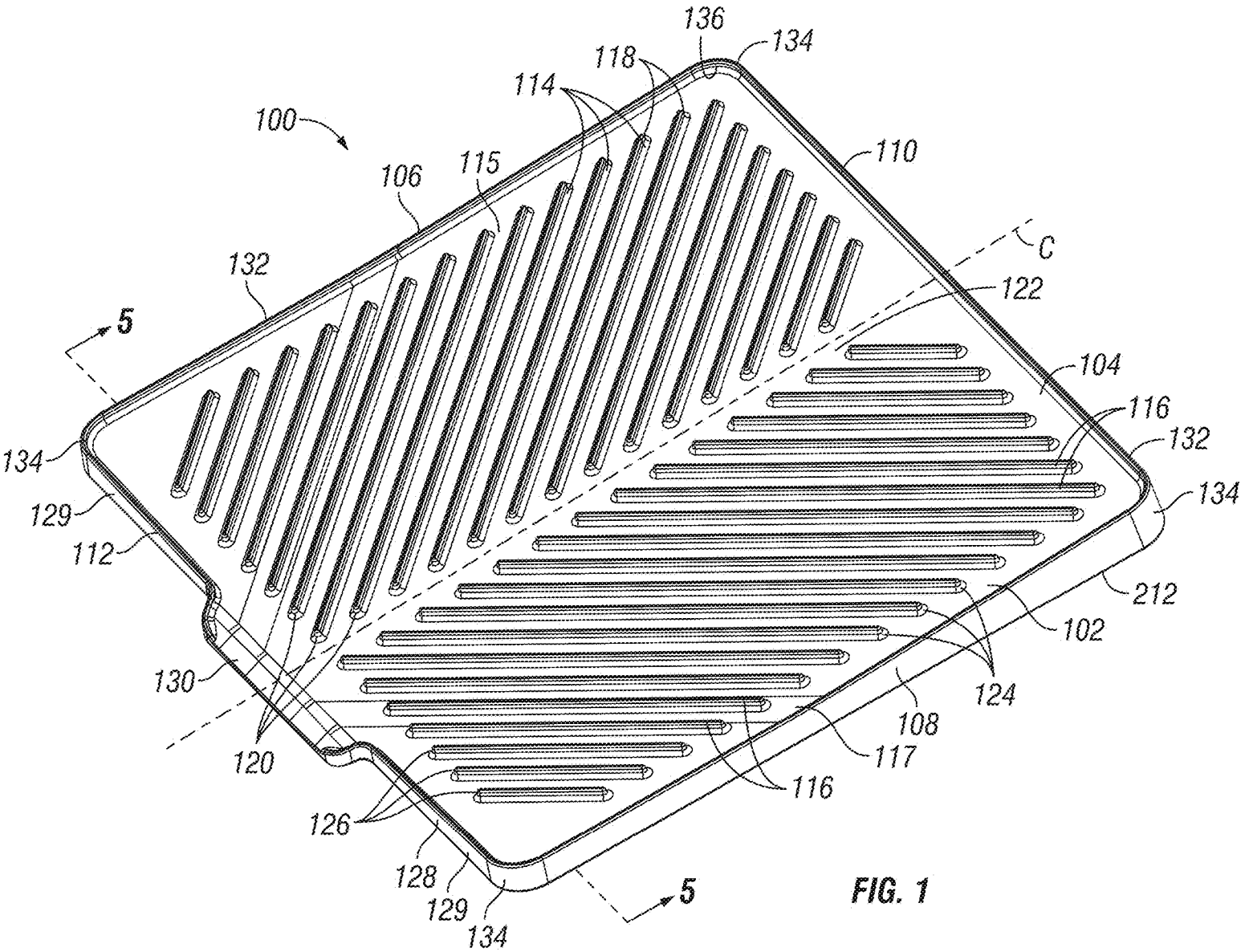
FIG. 1 is a top right front perspective view of a dish mat according to the invention.

Referring to FIG. 1, a dish mat according to the invention is generally indicated at 100. Dish mat 100 has a body 102 with a general upper surface 104. Mat 100 may be molded from a compound of one or more organic polymers or silicone, and more particularly may be integrally injection-molded from a thermoplastic elastomer (TPE) compound. In the illustrated embodiment, dish mat 100 is bilaterally symmetrical around, or is bisected by, a substantially longitudinally aligned center line C. In the illustrated embodiment, the mat 100 is rectangular with rounded corners 134. Mat 100 may be made in other shapes. The general upper surface 104 extends from a left margin 106 to a right margin 108, and from a back margin 110 to a front margin 112. The general upper surface 104 is downwardly sloped from back margin 110 to front margin 112 by a small angle to the horizontal, such as 2.8 degrees. This angle is chosen to be sufficient to encourage the drainage of fluid toward the front margin 112, but not to be so severe that items set on the dish mat 100 will tip over.

A plurality of elongate ribs upwardly extend from the general upper surface 104. The ribs include left ribs 114, which occupy a left portion 115 of the body 102, and right ribs 116, which occupy a right portion 117 of the body 102. Each left rib 114 has a back end 118 that is relatively proximate to left margin 106 and back margin 110, and a front end 120 that is relatively remote from left margin 106 and back margin 112 but relatively proximate to the front margin 112 and to a central, substantially longitudinally aligned channel 122. In the illustrated embodiment, the channel 122 is a rib-free portion of the general upper surface 104 that separates left ribs 114 from right ribs 116.

Similarly, each right rib 116 has a back end 124 that is relatively proximate to back margin 110 and to right margin 108, and a front end 126 that is relatively remote from margins 110, 108 but relatively proximate to channel 122 and to front margin 112. In the illustrated embodiment, the ribs 114, 116 are straight. The left ribs 114 are all parallel to each other and are arranged at an angle to both the longitudinal direction and to the transverse direction. Similarly, the right ribs 116 are all parallel to each other and are arranged at an angle to the longitudinal and transverse directions, and also are at an angle to ribs 114. In the illustrated embodiment, rib front ends and 126 define the transverse boundaries of channel 122.

In the illustrated embodiment, the open channel 122 is disposed on the center line C, but in other embodiments the channel 122 could be shifted to the left or to the right, and as a result one of the left portion 115 and the right portion 117 would be reduced in coverage, and the other of the left portion 115 and the right portion 117 would be extended.

An incompletely circumferential sidewall 128 is disposed at and defines left margin 106, back margin 110 and right margin 108. But sidewall 128 only extends along some of the front margin 112, forming a front sidewall 129 that is interrupted by a spillway 130. The sidewall 128 is substantially vertical, although it is somewhat outwardly sloped from top to bottom by a draft for ease in molding the body 102. Except at the corners 134, the sidewall 128 is planar. Sidewall 128 upwardly extends to a top margin 132 which is above general upper surface 104, as by 0.1 in. Sidewall 128 extends downwardly from general upper surface 104 by an amount that varies as a function of its distance from back margin 110; a height of sidewall 128 decreases as one approaches the front margin 112.

The spillway 130 is transversely aligned with channel 122, and in the illustrated embodiment, both are disposed on center line C. The spillway 130 extends forwardly from the rest of front margin 112.

The body 102 has four rounded corners 134. At each corner 134, the sidewall 128 makes an inwardly facing concave surface 136 that may receive a user's finger, making it easier to pick up mat 100. In the illustrated embodiment, the concave surfaces 136 have a radius of about 0.75 in.

Figure 2:
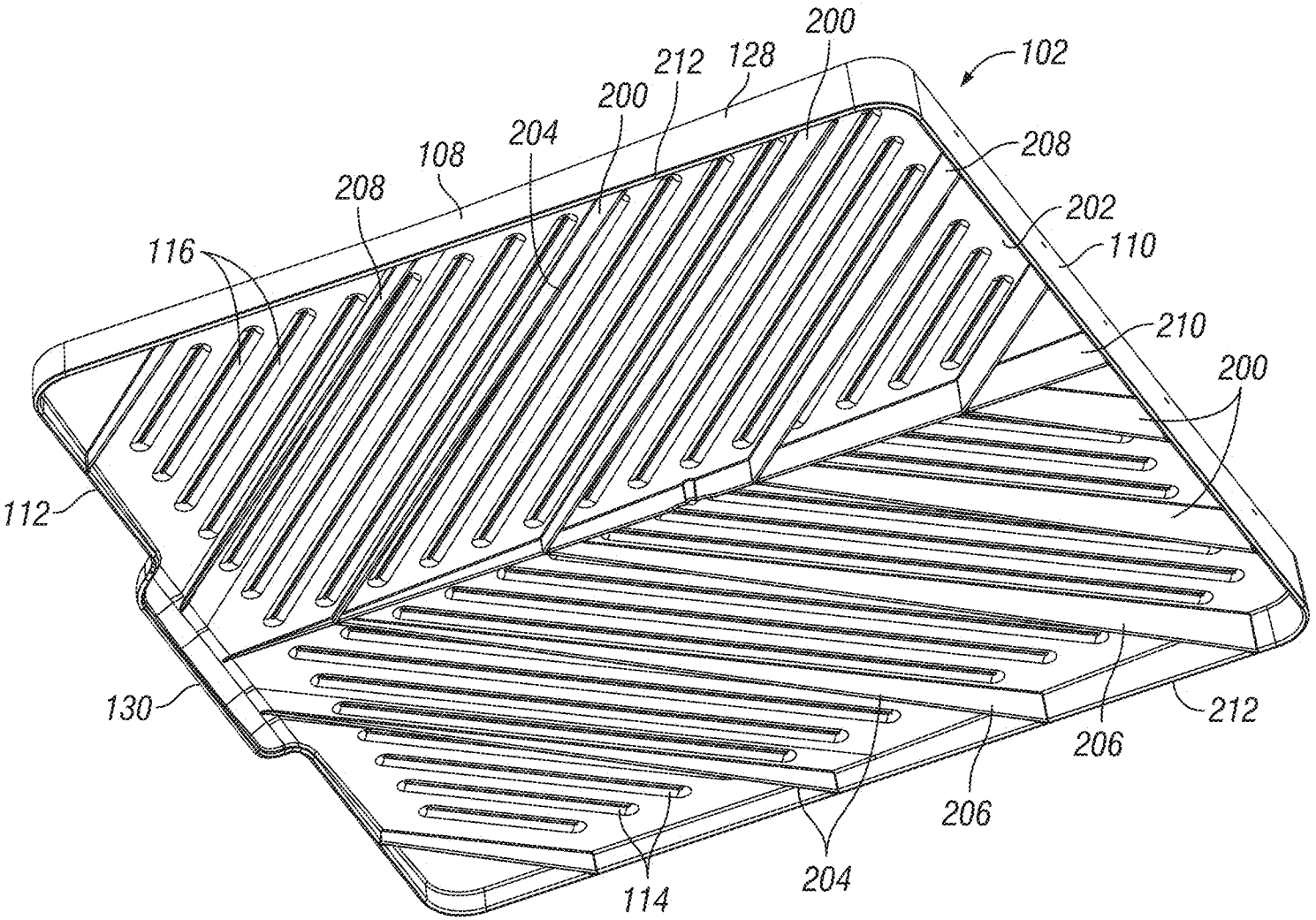
FIG. 2 is a bottom right perspective view of the dish mat shown in FIG. 1.

As seen in FIG. 2, a plurality of support ribs 200 downwardly extend from a general lower surface 202 of the mat body 102. The support ribs 200 each have a lower margin 204 that conforms to a common horizontal plane. The support ribs 200 have a depth, as measured between lower surface 202 and lower margin 204, that decreases linearly as a function of distance away from back end 110. This means that the support ribs 200 are not rectangular but are quadrangles with nonparallel sides.

Figure 3:
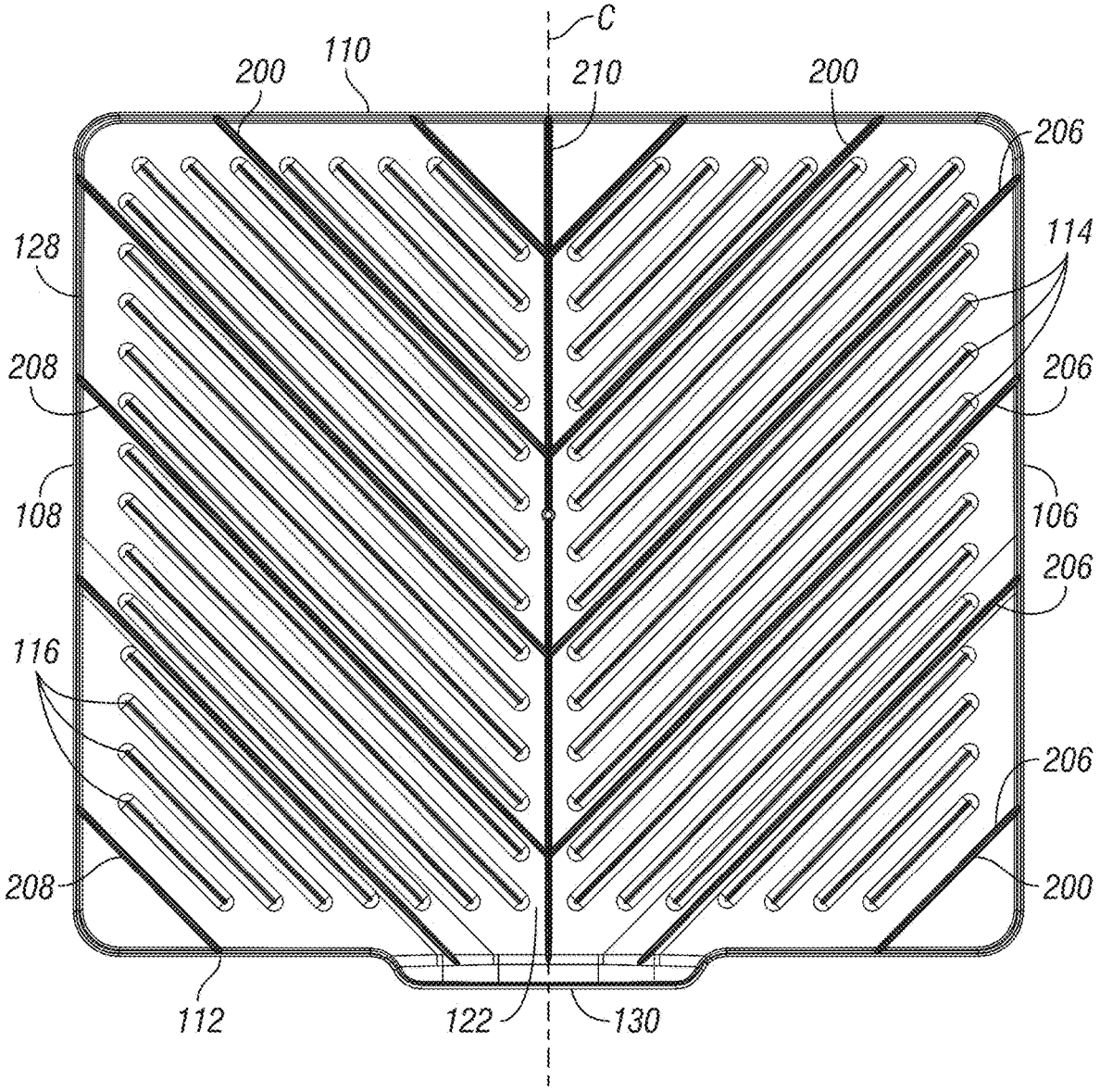
FIG. 3 is a bottom plan view of the dish mat shown in FIG. 1.

The support ribs 200 include a set of left support ribs 206, a set of right support ribs 208, and a center support rib 210 that is disposed on center line C (FIG. 3). Each of the support ribs 200 has a uniform thickness and in the illustrated embodiment is straight. The varying depth of the support ribs 200 and sidewall 128 produces the downward slope of the general upper surface 104 (FIG. 1), once the mat 100 is placed on a horizontal countertop.

Each support rib 200 has at least one end that terminates at peripheral sidewall 128. Many of the support ribs have a front end that is joined to the central support rib 210. Referring to FIG. 3, the support ribs 206, 208 and 210 are so positioned as to not intersect any of the upper ribs 114, 116; they have positions that are horizontally spaced from the ribs 114, 116. This is done to ease the injection-molding of mat 100. The right support ribs 208 are positioned at the same angle as right upper ribs 116, while the left support ribs 206 are positioned at the same angle as left upper ribs 114. The central support rib 210 is collocated with channel 122, and so it does not intersect any of the upper ribs 114, 116 either. In other embodiments, in which the upper ribs 114, 116 are not straight walls and/or parallel, support ribs 200 should be so bent, curved or otherwise configured so as not to intersect ribs 114, 116.

As seen in FIG. 2, a lower margin 212 of sidewall 128 conforms to the same horizontal plane as lower margins 204 of support ribs 200. The height of sidewall 128 from upper surface 104 (or from lower surface 202) decreases linearly as a function of the distance from back margin 110. In use, margins 212 and 204 will be in contact with a horizontal support surface such as a kitchen countertop, and support the entire weight of mat 100 and any dishware placed on it.

Figure 4:
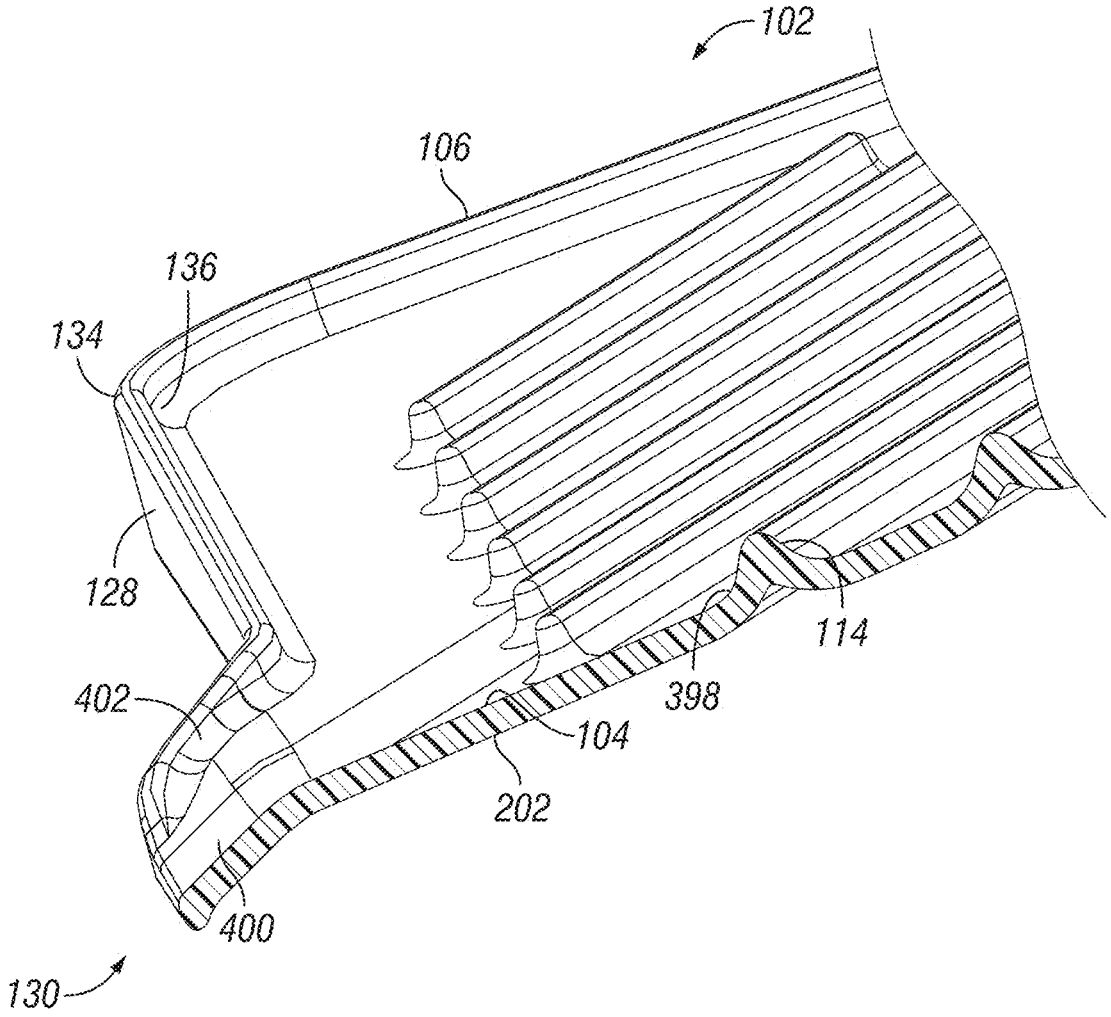
FIG. 4 is a longitudinal sectional detail of a mat spillway and nearby structure.

As seen in FIG. 4, the general upper surface 104 of body 102 is separated from the general lower surface 202 by a substantially uniform thickness. This means that a difference in height of a support rib 200 will translate to a difference in elevation of a point on surface 104 above the support rib 200. Also, FIG. 4 reveals that upper ribs 116 are hollow. Ribs 114 have a similar construction. Ribs 114 and 116 do not make an abrupt transition to the upper surface 104, but rather by upwardly concave curved transitions 398 that make the mat 100 easier to keep clean. For the same reason, that portion of sidewall 128 that extends upwardly from surface 104 similarly makes an upwardly concave curved transition to surface 104.

FIG. 4 also shows that an upper surface 400 of the spillway 130 forwardly and downwardly extends from general upper surface 104. The surface 400 is transversely bounded by a spillway wall 402, which extends from sidewall 128, and which may be about 0.1 in. high. A similar and corresponding spillway wall is disposed at the right margin of spillway surface 400 (not shown). This constrains fluid to move in a forward and downward direction.

Figure 5:
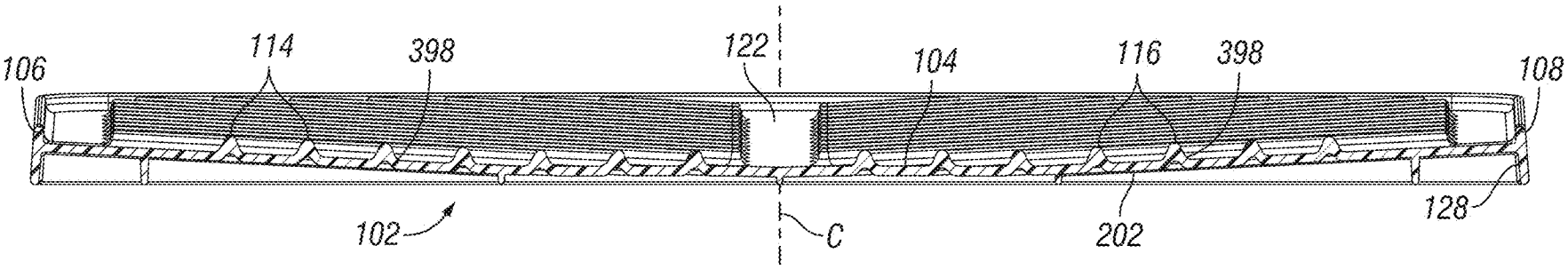
FIG. 5 is a transverse cross-sectional view taken substantially along line 5-5 of FIG. 1.

As seen in FIG. 5, and within a front portion of the body 102, the general upper surface 104, and the general lower surface 202 that is an analog of it, is slightly upwardly concave or sloped in a transverse direction. Surface 104 is downwardly sloped from left margin 106 to center line C, and is downwardly sloped from right margin 108 to center line C. This sloping toward channel 122 further urges fluid to channel 122, from whence it may enter the spillway 130. The maximum amount of transverse slope may be about 2.8 degrees to the horizontal.

In operation, mat 100 is placed adjacent a sink such that spillway 130 extends into it. Either dirty or clean dishware is placed on ribs 114, 116. Dirty dishes may have fluids such as sauce or grease on them. Clean dishes may be wet and may shed water. Fluid is shed from the dishware into the channels defined by 114 on left portion 115 and into channels defined by ribs 116 on the right portion 117. The fluid is then guided by ribs 114, 116 downward and transversely inward to channel 122. From there, the fluid flows downhill in channel 122 to spillway 130 and thence into the sink. Because of improved drainage characteristics, water from clean dishware won't accumulate but rather will run into the sink, and such water as remains will more easily evaporate.

In summary, a dish mat has been illustrated and described that has a sloped upper surface and ribs which direct fluid downward and inward to a channel, and thence via a spillway into an adjacent sink. The sloped surface is caused by linearly varying the degree to which the support ribs and outer margin downwardly extend from the general lower surface of the body.

While illustrated embodiments of the present invention have been described and illustrated in the appended drawings, the present invention is not limited thereto but only by the scope and spirit of the appended claims.

I claim:

1. A mat on which dishware may be placed in connection with a process for cleaning the dishware, the mat comprising:

a body having a length and a width at right angles to the length, a front of the body spaced from a back of the body by the length;

a general upper surface of the body upwardly spaced from a general lower surface of the body by a thickness of the body;

a plurality of elongate spaced-apart support ribs downwardly extending from the general lower surface of the body, the support ribs each having a back end relatively near the back of the body and a front end relatively remote from the back of the body, each support rib having a lower margin, a depth of each support rib from the general lower surface of the body to the lower margin decreasing as a function of distance from the back end of the support rib, wherein the lower margins of the support ribs substantially conform to a horizontal plane, thereby causing the general upper surface of the body to slope from the back of the body to the front of the body;

wherein the body has a left margin and a right margin spaced from the left margin by the width of the body, a center line aligned with the length of the body and located midway between the left margin and the right margin, the body having a front portion adjacent the front of the body, the general upper surface of the body within the front portion being downwardly sloped from the left margin to the center line and being downwardly sloped from the right margin to the center line; wherein a center support rib is disposed on the center line and downwardly extends from the general lower surface of the body, front ends of a plurality of the support ribs terminating at the center support rib.

2. The mat of claim 1, wherein the general upper surface of the body is upwardly and transversely concave within the front portion of the body.

3. A mat on which dishware may be placed in connection with a process for cleaning the dishware, the mat comprising:

a body having a length and a width at right angles to the length, a front of the body spaced from a back of the body by the length;

a general upper surface of the body upwardly spaced from a general lower surface of the body by a thickness of the body;

a plurality of elongate spaced-apart support ribs downwardly extending from the general lower surface of the body, the support ribs each having a back end relatively near the back of the body and a front end relatively remote from the back of the body, each support rib having a lower margin, a depth of each support rib from the general lower surface of the body to the lower margin decreasing as a function of distance from the back end of the support rib, wherein the lower margins of the support ribs substantially conform to a horizontal plane, thereby causing the general upper surface of the body to slope from the back of the body to the front of the body;

wherein the body has a front margin, a back margin, a left margin and a right margin, a peripheral sidewall downwardly extending from the general lower surface of the body to said horizontal plane, the peripheral sidewall extending around at least the back, left and right margins; and wherein the peripheral sidewall extends around a portion of the front margin.

4. The mat of claim 3, wherein:

a front portion of the peripheral sidewall is interrupted by a spillway, the spillway forwardly extending from the front portion of the peripheral sidewall, an upper surface of the spillway extending downwardly from the general upper surface of the body, whereby the spillway may be positioned over a sink edge and direct fluid from vessels and utensils placed on the body into the sink.

5. The mat of claim 4, wherein the spillway has a left margin and a right margin, an upstanding left spillway wall disposed at the left margin of the spillway, an upstanding right spillway wall disposed at the right margin of the spillway.

6. The mat of claim 4, further comprising an elongate channel forming a portion of the general upper surface and extending from the back of the body to the front of the body, the channel being aligned with the length of the body and disposed between the left margin and the right margin, a transverse position of the channel being aligned with the spillway.

7. The mat of claim 6, wherein a center line aligned with the length bisects the mat body, the spillway and channel being disposed on the center line.

8. A mat on which dishware may be placed in connection with a process for cleaning the dishware, the mat comprising:

a body having a length and a width at right angles to the length, a front of the body spaced from a back of the body by the length;

a general upper surface of the body upwardly spaced from a general lower surface of the body by a thickness of the body;

a plurality of elongate spaced-apart support ribs downwardly extending from the general lower surface of the body, the support ribs each having a back end relatively near the back of the body and a front end relatively remote from the back of the body, each support rib having a lower margin, a depth of each support rib from the general lower surface of the body to the lower margin decreasing as a function of distance from the back end of the support rib, wherein the lower margins of the support ribs substantially conform to a horizontal plane, thereby causing the general upper surface of the body to slope from the back of the body to the front of the body;

wherein a plurality of elongate spaced apart upper ribs upwardly extend from the general upper surface of the body, the upper ribs and the support ribs having horizontal positions, the horizontal positions of the support ribs not intersecting the horizontal positions of the upper ribs.

9. The mat of claim 8, wherein the mat is integrally molded of a thermoplastic elastomer.

10. The mat of claim 8, further characterized in that an elongate channel forms a portion of the general upper surface and extends from the back of the body to the front of body, the channel being aligned with the length of the body and disposed between the left margin and the right margin;

the body having a left portion disposed to the left of the channel and a right portion disposed to the right of the channel, the upper ribs including left ribs disposed on the left portion and right ribs disposed on the right portion, each upper rib having a back end and a front end, the back ends of the left ribs being disposed relatively proximate the left margin of the body and the back of the body, the front ends of the left ribs being disposed relatively proximate the channel and the front of the body, the back ends of the right ribs disposed relatively proximate the right margin of the body and the back of the body, the front ends of the right ribs being disposed relatively proximate to the channel and to the front of the body, wherein fluid from the dishware will be directed by the upper ribs to the channel, and will be directed by the channel to the front of the body.

11. The mat of claim 10, wherein front ends of a plurality of the left and right ribs define the channel.

12. The mat of claim 10, wherein the mat is integrally molded from a thermoplastic elastomer.

13. A mat on which dishware may be placed in connection with a process for cleaning the dishware, the mat comprising:

a body having a length and a width at right angles to the length, a front of the body spaced from a back of the body by the length;

a general upper surface of the body upwardly spaced from a general lower surface of the body by a thickness of the body;

a plurality of elongate spaced-apart support ribs downwardly extending from the general lower surface of the body, the support ribs each having a back end relatively near the back of the body and a front end relatively remote from the back of the body, each support rib having a lower margin, a depth of each support rib from the general lower surface of the body to the lower margin decreasing as a function of distance from the back end of the support rib, wherein the lower margins of the support ribs substantially conform to a horizontal plane, thereby causing the general upper surface of the body to slope from the back of the body to the front of the body;

wherein the body has a front margin, a back margin, a left margin and a right margin, a peripheral sidewall downwardly extending from the general lower surface of the body to said horizontal plane, the peripheral sidewall extending around at least the back, left and right margins; and wherein the peripheral sidewall has a top margin upwardly displaced from the general upper surface of the body.

* * * * *